US006394282B1

(12) United States Patent
Pan

(10) Patent No.: US 6,394,282 B1
(45) Date of Patent: May 28, 2002

(54) ANIMATED LIGHT SUPPORTING DISPLAY WITH SIDE-TO-SIDE HEAD MOVEMENT

(76) Inventor: Wen-Hua Pan, 7th Floor #285, Section 4 Chung Hsiao East Road, Taipei (TW)

( * ) Notice: Subject to any disclaimer, the term of this patent is extended or adjusted under 35 U.S.C. 154(b) by 0 days.

(21) Appl. No.: 09/817,384

(22) Filed: Mar. 27, 2001

Related U.S. Application Data

(60) Provisional application No. 60/218,841, filed on Jul. 18, 2000.

(51) Int. Cl.[7] ..... A47F 3/08

(52) U.S. Cl. ..... 211/1.51; 211/181.1; 211/26; D11/127; 428/8; 362/252; 40/414

(58) Field of Search ..... 211/181.1, 26, 211/1.51, 1.57; 428/8, 7, 12; D11/127, 158, 159; 40/411, 414, 418, 421, 423; 362/252

(56) References Cited

U.S. PATENT DOCUMENTS 4,650,701 A * 3/1987 Jackson ..... 428/16
5,320,571 A * 6/1994 Lo ..... 40/412 X
5,379,202 A * 1/1995 Duan ..... 362/252
5,451,436 A * 9/1995 Shelleman ..... 428/8
5,683,172 A * 11/1997 Huag ..... 362/252
5,784,815 A * 7/1998 Hermanson ..... 40/414
5,850,927 A 12/1998 Pan
6,180,193 B1 * 1/2001 Bostedt ..... 428/7

FOREIGN PATENT DOCUMENTS

CN 96236724.9 9/1997

* cited by examiner

*Primary Examiner*—Robert W. Gibson, Jr.
(74) *Attorney, Agent, or Firm*—Donald A. Kettlestrings

(57) ABSTRACT

An animated light sculpture framework is configured for enabling the framework to be quickly and easily unfolded and erected for use and to be quickly and easily folded together into a compact configuration for transport and/or storage. A head and neck portion of the light sculpture framework is movable from side-to-side in an oscillating manner to simulate natural movement by use of a motor connected to the framework.

14 Claims, 1 Drawing Sheet

ANIMATED LIGHT SUPPORTING DISPLAY WITH SIDE-TO-SIDE HEAD MOVEMENT

This application claims benefits of U.S. Pat. No. 60/218,841 filed Jul. 18, 2000.

BACKGROUND OF THE INVENTION

This invention relates to an animated light sculpture framework and more particularly to an animated, free-standing, collapsible, three-dimensional wire framework and light supporting display for use as a decorative light sculpture wherein the head and neck portions of the display are moved from side-to-side in an oscillating manner.

U.S. Pat. No. 5,850,927 is incorporated by reference into this application, as provided by Manual of Patent Examining Procedure, Section 608.01(p). Particular attention is directed to the drawings and specification of U.S. Pat. No. 5,850,927 where the subject matter being incorporated may be found. Further, the reference numerals used in U.S. Pat. No. 5,850,927 to identify various elements of the invention described therein are also used herein to identify identical elements found in this invention.

It is an object of the present invention to provide an animated, free-standing, three-dimensional, collapsible wire framework and light supporting display for use as a light sculpture wherein the head and neck portions of the display are moved from side-to-side in an oscillating manner.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides an animated, collapsible, three-dimensional wire frame-work and light supporting display comprising: a first wire frame assembly defining a first predetermined portion of a figure; a second wire frame assembly defining a second predetermined portion of the figure, the second frame assembly hingedly connected to the first frame assembly for movement between a first open position and a second closed position in relationship with the first frame assembly; a third wire frame assembly defining a third predetermined portion of the figure; at least one fourth wire frame support assembly defining a fourth predetermined portion of the figure, the fourth frame assembly connected to the first frame assembly; a motor connected to the first wire frame assembly; a first arm member connected to and extending from the motor for rotation in response to activation of the motor; a second arm member defining first and second ends, the first end rotatably attached to the first arm member; a first receptacle attached to the third wire frame assembly; the second end of the second arm member rotatably positioned within the first receptacle; second and third receptacles attached to the third wire frame assembly; a first wire element defining a distal end attached to and extending from the second wire frame assembly; a second wire element defining a distal end and attached to and extending from the first wire frame assembly; the distal end of first wire element positioned within the second receptacle; and the distal end of the second wire element positioned within the third receptacle, whereby activation of the motor causes substantially side-to-side oscillating movement of the third wire frame assembly.

It is to be understood that both the foregoing general description and the following detailed description are exemplary and explanatory but are not restrictive of the invention.

BRIEF DESCRIPTION OF THE SEVERAL VIEWS OF THE DRAWINGS

The accompanying drawings, which are incorporated in and constitute a part of this specification, illustrate a preferred embodiment of the invention and, together with the description, serve to explain the principles of the invention.

DETAILED DESCRIPTION OF THE INVENTION

Figure 1:
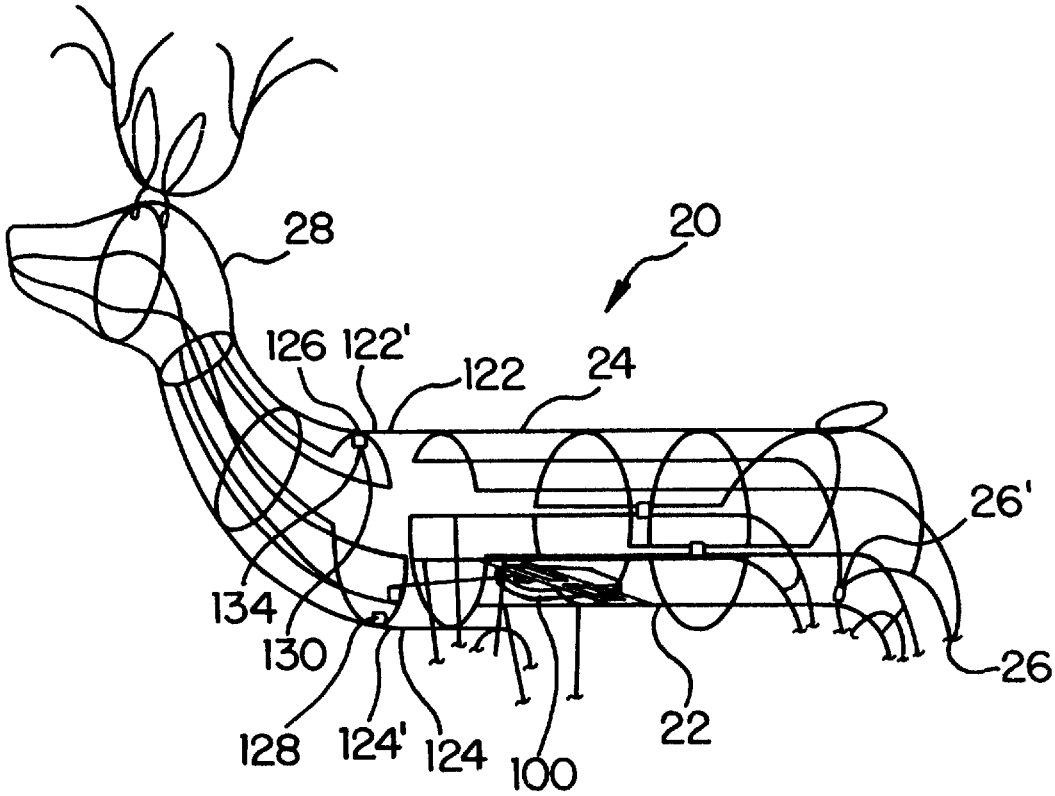
FIG. 1 is a fragmentary perspective view of the invention.
Figure 2:
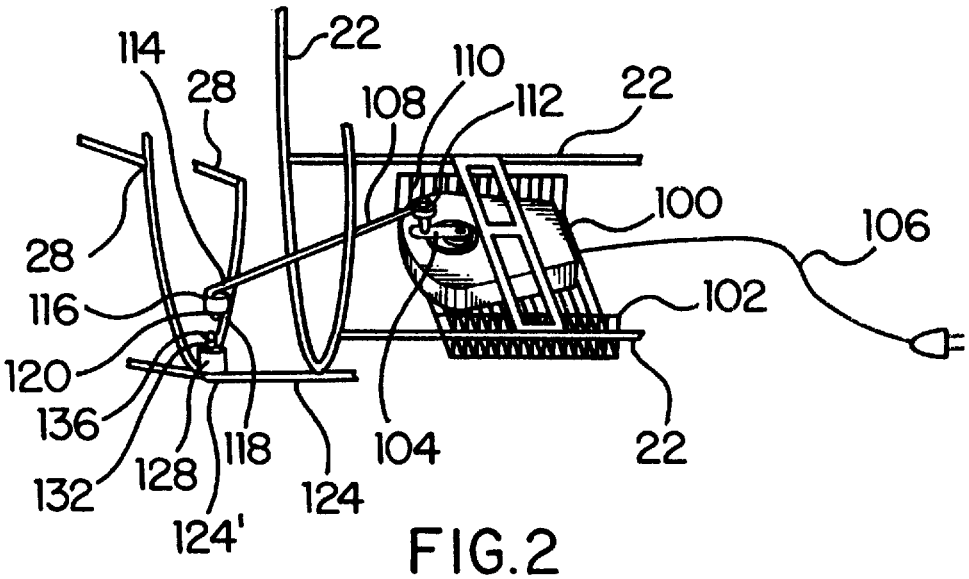
FIG. 2 is a fragmentary perspective view of the invention showing a detailed illustration of the motor and its connection to the head and neck portions of the display.

With reference now to the drawings, wherein like reference characters designate like or corresponding parts throughout the several views, there is shown animated wire framework and light supporting display assembly 20 in the shape of a deer, including the head and neck portions 28 of a deer. Assembly 20 includes first and second wire frame assemblies 22, 24 defining lower and upper body portions of the deer, respectively. Second frame assembly 24 is hingedly connected to first frame assembly 22 by hinges 26, 26'.

Animation of the wire frame assembly 20 in the shape of a deer (see U.S. Pat. No. 5,850,927), including the head and neck portions 28 of a deer, is provided by mounting a conventional electrically powered motor 100 to first wire frame assembly 22, which is a lower body portion of a deer. Preferably, motor 100 is suspended beneath wire frame assembly 22 and is connected to assembly 22 by welding or other conventional means. A wire cage 102 preferably at least partially protectively surrounds motor 100, and cage 102 is conventionally attached to frame assembly 22, such as by welding or other similar conventional means.

Motor 100 includes an arm 104 which extends from the motor and which rotates or oscillates in response to activation of the motor by electricity. Motor 100 is connected to a conventional electrical source of power (not shown) by a conventional electrical cord 106.

A second, L-shaped arm 108 is rotatably attached at a first end 110 thereof to motor arm 104 by a pin 112.

Second end 114 of L-shaped arm 108 is rotatably positioned through cylindrical receptacle 116, which is conventionally attached to the neck portion 28 of wire frame assembly 20, such as by welding. Receptacle 116 is attached to portion 28 at a distance away or set off from a centerline axis (not shown) of portion 28 and of frame assembly 20 to facilitate side-to-side movement of portion 28, as will be explained in more detail hereinafter.

End 114 of arm 108 defines an opening 118 therein, and a pin 120 is removably positioned through opening 118 to hold forward end 114 of arm member 108 within cylindrical receptacle 116.

Wire element 122, which is a part of upper body portion wire frame assembly 24, extends forwardly from upper body portion 24 of the deer. Similarly, wire element 124, which is a part of lower body portion wire frame assembly 22, extends forwardly from lower body portion 22. Wire element 122 defines a distal end portion 122', and wire element 124 defines a distal end portion 124'. End portions 122', 124' are bent at substantially ninety degrees from wire element 122 and wire element 124, respectively. End portion 122' is bent downwardly, and end portion 124' is bent upwardly.

A cylindrical receptacle 126 is connected in a conventional manner, such as by welding, to a rear portion of wire frame assembly 28, which defines the head and neck portions of the deer. Similarly, cylindrical receptacle 128 is conventionally connected, such as by welding, to a lower rear portion of wire frame assembly 28.

End portion 122' defines an opening 130 therein, and end portion 124' defines an opening 132 therein. A pin 134 is removably positioned through opening 130 to keep end portion 122' within cylindrical receptacle 126, and a pin 136 is positioned through opening 132 to keep end portion 124' positioned within cylindrical receptacle 128.

In operation and use, electrical cord 106 is connected to a conventional electrical outlet (not shown) to energize motor 100. Energization of motor 100 causes motor arm 104 to rotate or oscillate, depending upon the conventional configuration of motor 100. This, in turn, causes arm 108 to impart oscillatory motion to wire framework 28 as end 114 moves within cylindrical receptacle 116. Because cylindrical receptacle 116 is offset from the center line of head and neck assembly 28, movement of end portion 114 within cylindrical receptacle 116 results in side-to-side, oscillatory motion of head and neck portion 28.

The oscillatory, side-to-side motion of head and neck portion 28 is possible because of the movement of cylindrical receptacles 126, 128 about end portions 122', 124', respectively.

When it is desired to collapse or fold framework 20 from its erected configuration, second wire frame assembly 24, which is the upper body portion of the deer, is opened by rotating frame assembly 24 upwardly and backwardly about hinges 26, 26'. (See U.S. Pat. No. 5,850,927). This allows access to the interior of display 20. Before this can occur, however, pins 134, 136 are removed from openings 130, 132, and cylindrical receptacles 126, 128 are removed from end portions 122', 124'. Also, pin 120 is removed from opening 118 and end 114 of arm 108 is removed from cylindrical receptacle 116.

Display 20 can then be collapsed or folded from its erected configuration into the compact folded configuration shown in FIG. 5 of U.S. Pat. No. 5,850,927 for storage or transport, and the removed head and neck portion 28 can be stored within the body portion of the deer as defined by body portions 22, 24 of the deer.

Electrical cord 106 is preferably electrically connected in a conventional manner to conventional string lights (not shown), such as Christmas lights, which can be quickly and easily removably attached to framework 20 in a conventional manner.

The invention in its broader aspects is not limited to the specific details shown and described, and departures may be made from such details without departing from the principles of the invention and without sacrificing its chief advantages.

What is claimed is:

1. An animated, collapsible, three-dimensional wire framework and light supporting display comprising:

a first wire frame assembly defining a first predetermined portion of a figure;

a second wire frame assembly defining a second predetermined portion of said figure, said second frame assembly hingedly connected to said first frame assembly for movement between a first open position and a second closed position in relationship with said first frame assembly;

a third wire frame assembly defining a third predetermined portion of said figure;

at least one fourth wire frame support assembly defining a fourth predetermined portion of said figure, said fourth frame assembly connected to said first frame assembly;

a motor connected to said first wire frame assembly;

a first arm member connected to and extending from said motor for rotation in response to activation of said motor;

a second arm member defining first and second ends, said first end rotatably attached to said first arm member;

a first receptacle attached to said third wire frame assembly;

said second end of said second arm member rotatably positioned within said first receptacle;

second and third receptacles attached to said third wire frame assembly;

a first wire element defining a distal end attached to and extending from said second wire frame assembly;

a second wire element defining a distal end and attached to and extending from said first wire frame assembly;

said distal end of first wire element positioned within said second receptacle; and said distal end of said second wire element positioned within said third receptacle, whereby activation of said motor causes substantially side-to-side oscillating movement of said third wire frame assembly.

2. A framework and display as in claim 1 wherein said first, second and third wire frame assemblies are sized and configured for enabling said third wire frame assembly to be positioned and stored within and between said first and second wire frame assemblies.

3. A framework and display as in claim 1 wherein said fourth frame assembly is hingedly connected to said first frame assembly for movement between a first erected position and a second folded position.

4. A framework and display as in claim 3 including a plurality of said fourth wire frame support assemblies, and wherein said fourth frame assemblies in said folded positions are located in side-by-side relationship with respect to each other.

5. A framework and display as in claim 1 wherein said second end of said second arm member is removably positioned within said first receptacle.

6. A framework and display as in claim 1 wherein said distal ends of said first and second wire elements are removably positioned within said second and third receptacles, respectively.

7. An animated, collapsible, three-dimensional wire framework and light supporting display comprising:

a first wire frame assembly defining a first predetermined portion of a figure;

a second wire frame assembly defining a second predetermined portion of said figure, said second frame assembly hingedly connected to said first frame assembly for movement between a first open position and a second closed position in relationship with said first frame assembly;

a third wire frame assembly defining a third predetermined portion of said figure;

at least one fourth wire frame support assembly defining a fourth predetermined portion of said figure, said fourth frame assembly connected to said first frame assembly;

a motor connected to said first wire frame assembly;

a first arm member connected to and extending from said motor for rotation in response to activation of said motor;

a second arm member defining first and second ends, said first end rotatably attached to said first arm member;

a first receptacle attached to said third wire frame assembly;

said second end of said second arm member rotatably positioned within said first receptacle; and first means in operative relationship with said first, second and third wire frame assemblies for movably and removably connecting said third wire frame assembly to said first and second wire frame assemblies and for enabling substantially side-to-side oscillating movement of said third wire frame assembly upon activation of said motor.

8. A framework and display as in claim 7 wherein said first means include:

second and third receptacles attached to said third wire frame assembly;

a first wire element defining a distal end attached to and extending from said second wire frame assembly;

a second wire element defining a distal end and attached to and extending from said first wire frame assembly;

said distal end of first wire element positioned within said second receptacle; and said distal end of said second wire element positioned within said third receptacle, whereby activation of said motor causes substantially side-to-side oscillating movement of said third wire frame assembly.

9. A framework and display as in claim 7 wherein said first, second and third wire frame assemblies are sized and configured for enabling said third wire frame assembly to be positioned and stored within and between said first and second wire frame assemblies.

10. A framework and display as in claim 7 wherein said fourth frame assembly is hingedly connected to said first frame assembly for movement between a first erected position and a second folded position.

11. A framework and display as in claim 10 including a plurality of said fourth wire frame support assemblies, and wherein said fourth frame assemblies in said folded positions are located in side-by-side relationship with respect to each other.

12. A framework and display as in claim 7 wherein said second end of said second arm member is removably positioned within said first receptacle.

13. A framework and display as in claim 7 wherein said distal ends of said first and second wire elements are removably positioned within said second and third receptacles, respectively.

14. An animated, collapsible, three-dimensional wire framework and light supporting display comprising:

a first wire frame assembly defining a first predetermined portion of a figure;

a second wire frame assembly defining a second predetermined portion of said figure, said second frame assembly in operative relationship with said first frame assembly for movement between a first open position and a second closed position in relationship with said first frame assembly;

a third wire frame assembly defining a third predetermined portion of said figure;

at least one fourth wire frame support assembly defining a fourth predetermined portion of said figure, said fourth frame assembly connected to said first frame assembly;

a motor connected to said first wire frame assembly;

a first arm member connected to and extending from said motor for rotation in response to activation of said motor;

a second arm member defining first and second ends, said first end rotatably attached to said first arm member;

a first receptacle attached to said third wire frame assembly;

said second end of said second arm member rotatably positioned within said first receptacle; and first means in operative relationship with said first, second and third wire frame assemblies for movably and removably connecting said third wire frame assembly to said first and second wire frame assemblies and for enabling substantially side-to-side Oscillating movement of said third wire frame assembly upon activation of said motor.

* * * * *